US006595435B1

(12) United States Patent
Cardenas

(10) Patent No.: US 6,595,435 B1
(45) Date of Patent: Jul. 22, 2003

(54) WATERFALL APPARATUS

(75) Inventor: Oscar Cardenas, Perris, CA (US)

(73) Assignee: Vortex Whirlpool Systems, Inc., Perris, CA (US)

( * ) Notice: Subject to any disclaimer, the term of this patent is extended or adjusted under 35 U.S.C. 154(b) by 0 days.

(21) Appl. No.: 10/277,326

(22) Filed: Oct. 21, 2002

(51) Int. Cl.[7] ..... B05B 17/08; E04H 4/00

(52) U.S. Cl. ..... 239/17; 239/22; 239/193; 4/507

(58) Field of Search ..... 239/16, 17, 22, 239/533.15, 193, 289, 597, 598, 203–204; 4/507

(56) References Cited

U.S. PATENT DOCUMENTS

| | | | | |
|---|---|---|---|---|
| 3,722,816 A | * | 3/1973 | Stewart et al. | 239/17 |
| 4,881,280 A | | 11/1989 | Lesikar | |
| 5,249,744 A | | 10/1993 | Ruthenberg | |
| 5,537,696 A | | 7/1996 | Chartier | |
| 6,170,094 B1 | * | 1/2001 | Weise et al. | 4/507 |
| 6,367,100 B2 | * | 4/2002 | Koren et al. | 4/507 |
| 6,382,520 B1 | * | 5/2002 | Hones | 239/12 |
| 6,450,418 B1 | | 9/2002 | Simpson et al. | |

* cited by examiner

*Primary Examiner*—Michael Mar
*Assistant Examiner*—Darren Gorman
(74) *Attorney, Agent, or Firm*—Loyal McKinley Hanson

(57) ABSTRACT

A spa with a pop-up waterfall apparatus constructed according to the invention includes a container for a reservoir of water and a water-sheeting manifold assembly mounted on the container The water-sheeting manifold assembly includes a water-sheeting manifold that is adapted for movement between a lowered first position and an elevated second position. A waterfall apparatus constructed according to one aspect of the invention includes a housing defining an upwardly opening chamber that extends from a bottom portion of the housing to a top portion of the housing, and it also includes a water-sheeting manifold that fits at least partially within the upwardly opening chamber. The housing includes a water inlet in fluid communication with the upwardly opening chamber that functions as means for coupling water from a separate source of pressurized water to the upwardly opening chamber. The water-sheeting manifold fits in the upwardly opening chamber moveably for upward movement under influence of water pressure in the upwardly opening chamber from the lowered first position to the elevated second position in which the water-sheeting manifold presents a higher profile and discharges a sheet of water simulating a waterfall.

3 Claims, 5 Drawing Sheets

4
18
31
19
11
23
24
17
26
WATER SOURCE
22
27
ON OFF VALVE
25
4

WATERFALL APPARATUS

BACKGROUND OF THE INVENTION

1. Technical Field

This invention relates generally to pools, spas, hot tubs, and the like, and more particularly to a waterfall apparatus for recreational and therapeutic water reservoir containers.

2. Description of Related Art

A water-sheeting manifold assembly is sometimes referred to as a waterfall apparatus. It includes a water-sheeting manifold in the form of an enclosure that receives a flow of water form a pressurized source and discharges a sheet of water that simulates a waterfall. The enclosure defines a chamber into which the water flows. The enclosure also defines an outlet in the form of a horizontally extending slot out of which the sheet of water is discharged. The waterfall is visually appealing and provides a soothing sound.

Some existing recreational and therapeutic water reservoir containers, such as pools, spas, hot tubs, and the like, include some form of waterfall apparatus connected to the reservoir water supply. The waterfall apparatus receives water at an inlet on the waterfall apparatus and discharges a sheet of water through a horizontally extending slot to produce a waterfall that falls to the surface of the water below. Various examples and details of construction are described in U.S. Pat. Nos. 6,450,418; 5,537,696; 5,249,744; and 4,881,280.

Although commonly used, some waterfall apparatuses have certain problems. A typical spa waterfall apparatus, for example, may be mounted on a sidewall of a spa. It extends upwardly from the upper edge of the sidewall (the peripheral edge of the spa) where it pours a sheet of water inwardly and downwardly toward the surface of the water in the spa. One problem with such a waterfall apparatus is that it presents a profile that remains visible and in the way when not in use. Thus, a need exists for a waterfall apparatus that overcomes this concern.

SUMMARY OF THE INVENTION

It is an object of this invention to overcome the forgoing and other disadvantages of prior art waterfall apparatuses. This object is achieved by providing what may be referred to as a pop-up waterfall apparatus. It includes a water-sheeting manifold that moves (preferably under influence of water pressure) from a lowered position that presents a low profile to an elevated position in which the waterfall is produced. When not in use, the waterfall apparatus is less visible and out of the way.

To paraphrase some of the more precise language appearing in the claims in order to develop the nomenclature employed, a spa with a waterfall apparatus constructed according to the invention includes a container for a reservoir of water and a water-sheeting manifold assembly mounted on the container. As used in this description and the following claims, the word "spa" includes pools, tubs, and any other such containers for a reservoir of water, including those used for recreational or therapeutic purposes.

According to a major aspect of the invention, the water-sheeting manifold assembly on the spa container includes a water-sheeting manifold that is adapted for movement between a lowered first position and an elevated second position. Preferably, the water-sheeting manifold assembly is adapted to raise the water-sheeting manifold from the first position to the second position under influence of water pressure, and a control panel is provided for enabling a user to control a flow of water from a separate source of pressurized water to the water-sheeting manifold assembly in order to thereby selectively raise and lower the water-sheeting manifold.

A water-sheeting manifold assembly constructed according to one aspect of the invention includes a housing defining an upwardly opening chamber that extends from a bottom portion of the housing to a top portion of the housing, and a water-sheeting manifold that fits at least partially within the upwardly opening chamber. The housing includes a water inlet in fluid communication with the upwardly opening chamber that functions as means for coupling water from a separate source of pressurized water to the upwardly opening chamber. The water-sheeting manifold fits in the upwardly opening chamber moveably for upward movement under influence of water pressure in the upwardly opening chamber from a lowered first position to an elevated second position. In the first position, the water-sheeting manifold presents a low profile. In the second position, it presents a higher profile and discharges a sheet of water simulating a waterfall.

Thus, the invention provides a pop-up waterfall apparatus that alleviates some disadvantages of prior art waterfall apparatuses. The following illustrative drawings and detailed description make the foregoing and other objects, features, and advantages of the invention more apparent.

DESCRIPTION OF THE PREFERRED EMBODIMENTS

Figure 1:
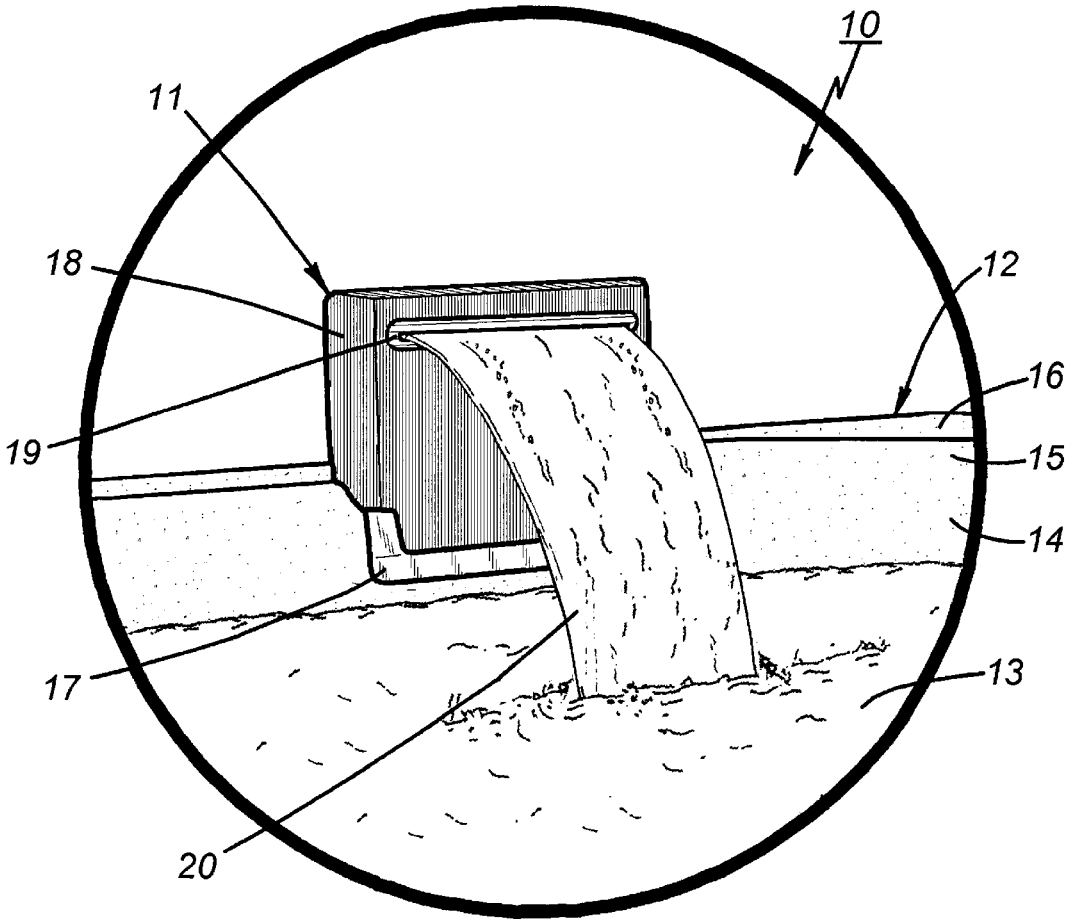
FIG. 1 of the drawings is a rendition of a spa waterfall accessory constructed according to the invention that is shown installed in a typical spa, with the movable element in an elevated position.
Figure 2:
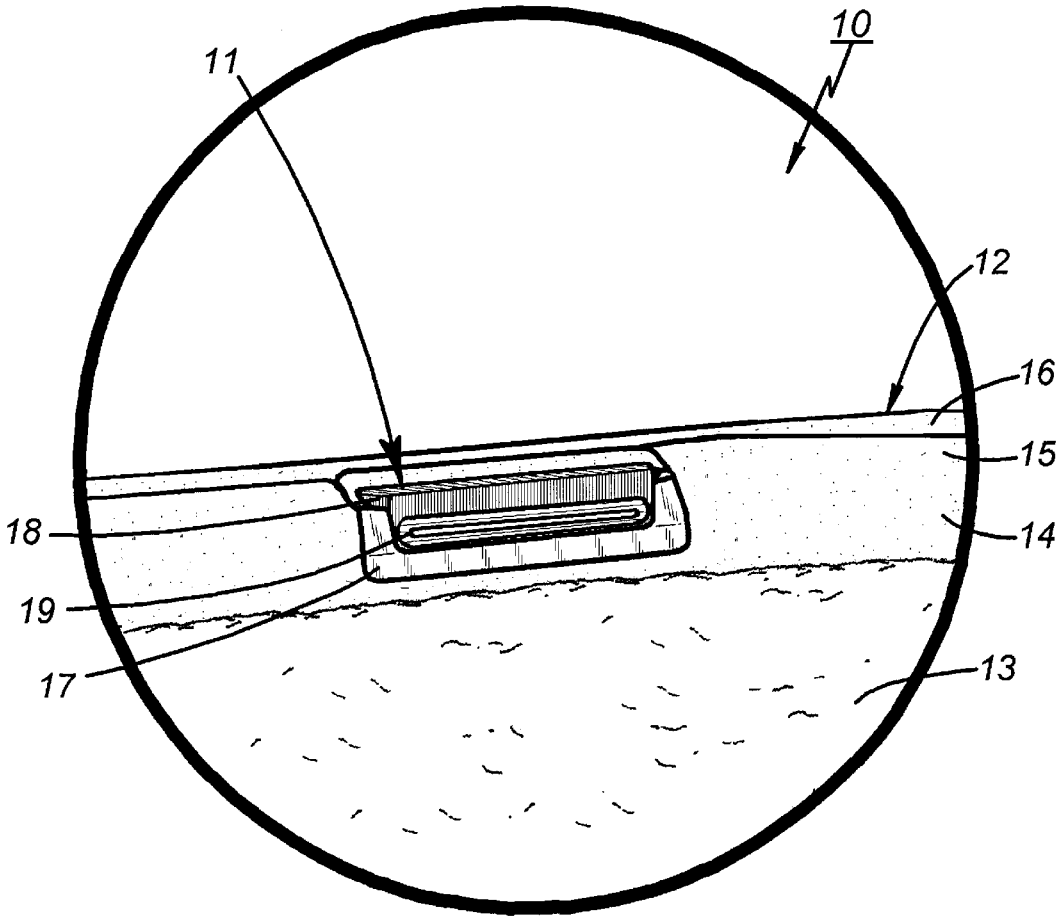
FIG. 2 is a rendition of the waterfall accessory similar to FIG. 1, but with the movable element in a lowered position.

FIGS. 1–2 of the drawings show various aspects of a spa 10 that includes a waterfall apparatus 11 constructed according to the invention. Apart from the waterfall apparatus 11, however, the spa 10 is conventional in that it includes a container 12 for containing a water reservoir 13 (i.e., a body of water). The container 12 includes a sidewall 14 that extends upwardly to an upper portion 15 of the sidewall 14, and the upper portion 15 terminates in an upper edge 16. Those elements of the spa 10 are similar to elements of many existing spas, including those available from Vortex Whirlpool Systems, Inc. of Perris, Calif. Of course, the spa 10 includes other elements that are not mentioned here because they are not needed to describe the waterfall apparatus 11. As stated previously, the term "spa" includes any of various types and kinds of pools, spas, tubs, and other containers for water reservoirs, including those used for recreational and therapeutic purposes.

The waterfall apparatus 11 is a water-sheeting manifold assembly. It includes a housing 17 mounted on the sidewall 14, and a water-sheeting manifold 18 that fits at least partially in the housing 17. The water-sheeting manifold 18 is shown in an elevated or operative first position in FIG. 1 where it presents a higher profile than the lower profile presented in the non-operating second position shown in FIG. 2. In the elevated first position, water flows from a water outlet 19 on the water-sheeting manifold 18 as a sheet of water 20 (FIG. 1). In the lowered second position (FIG. 2), water is not supplied to the water-sheeting manifold 18 and so there is no water pressure to raise it and no sheet of water 20 flows from it.

Thus, the waterfall apparatus 11 may be referred to as a pop-up waterfall apparatus. The water-sheeting manifold 18 moves from the lowered first position to the elevated second position under influence of water pressure in the housing 17 when a separate source of pressurized water is coupled to the housing 17. When the water is turned off, the water-sheeting manifold 18 falls back down into the housing 17 under influence of gravity. That operation may be likened to the operation of commonly used pop-up irrigation sprinklers. From the foregoing and subsequent descriptions, one of ordinary skill in the art can readily implement a pop-up waterfall apparatus according to the invention. Moreover, movement of the water-sheeting manifold may be accomplished by means other than the hydraulic lifting method used for the water-sheeting manifold 18, including non-hydraulic mechanical means, within the broader scope of the invention and the claims.

Figure 3:
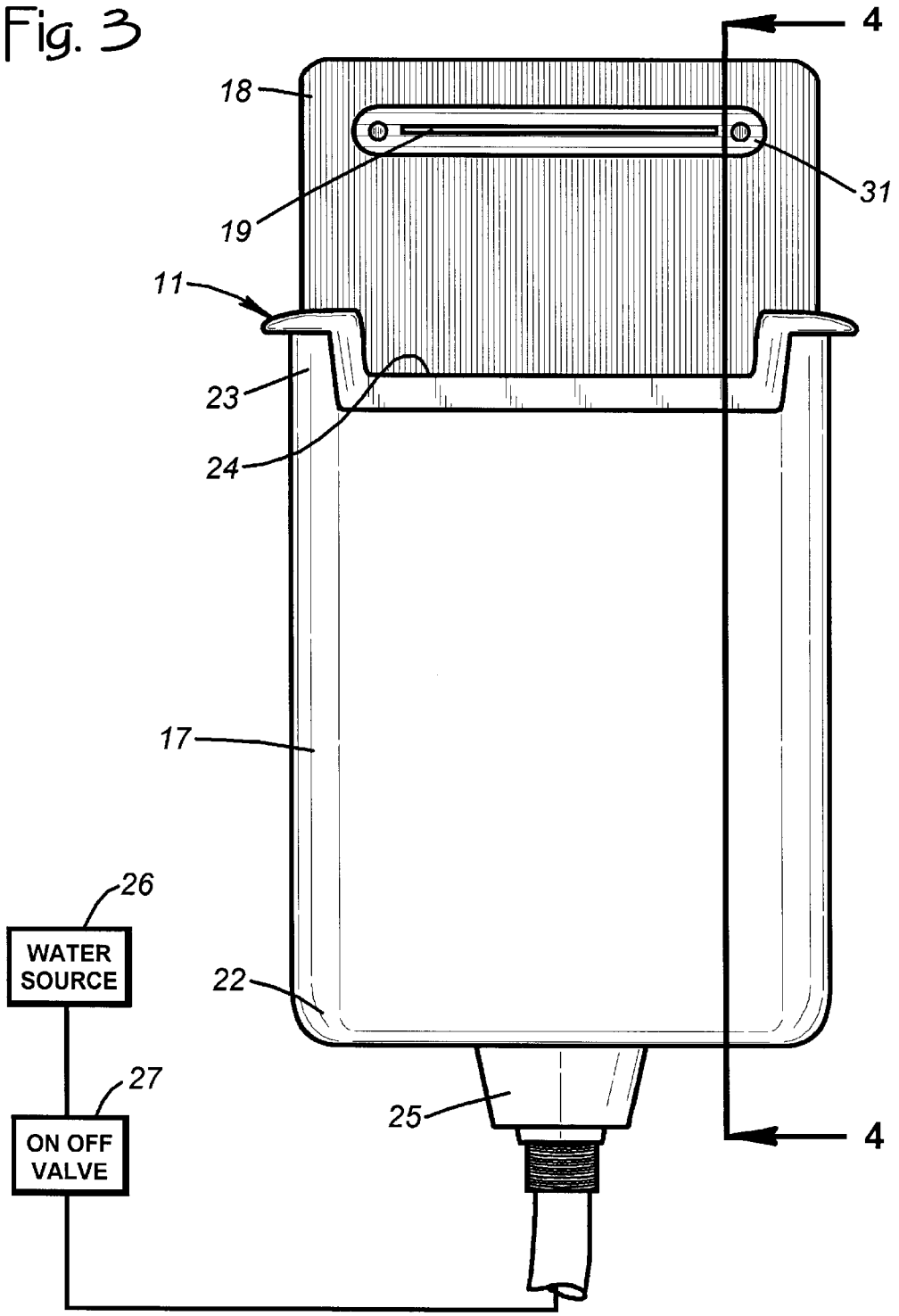
FIG. 3 is an enlarged front elevation plan of the waterfall accessory with waterline connections depicted diagrammatically.
Figure 4:
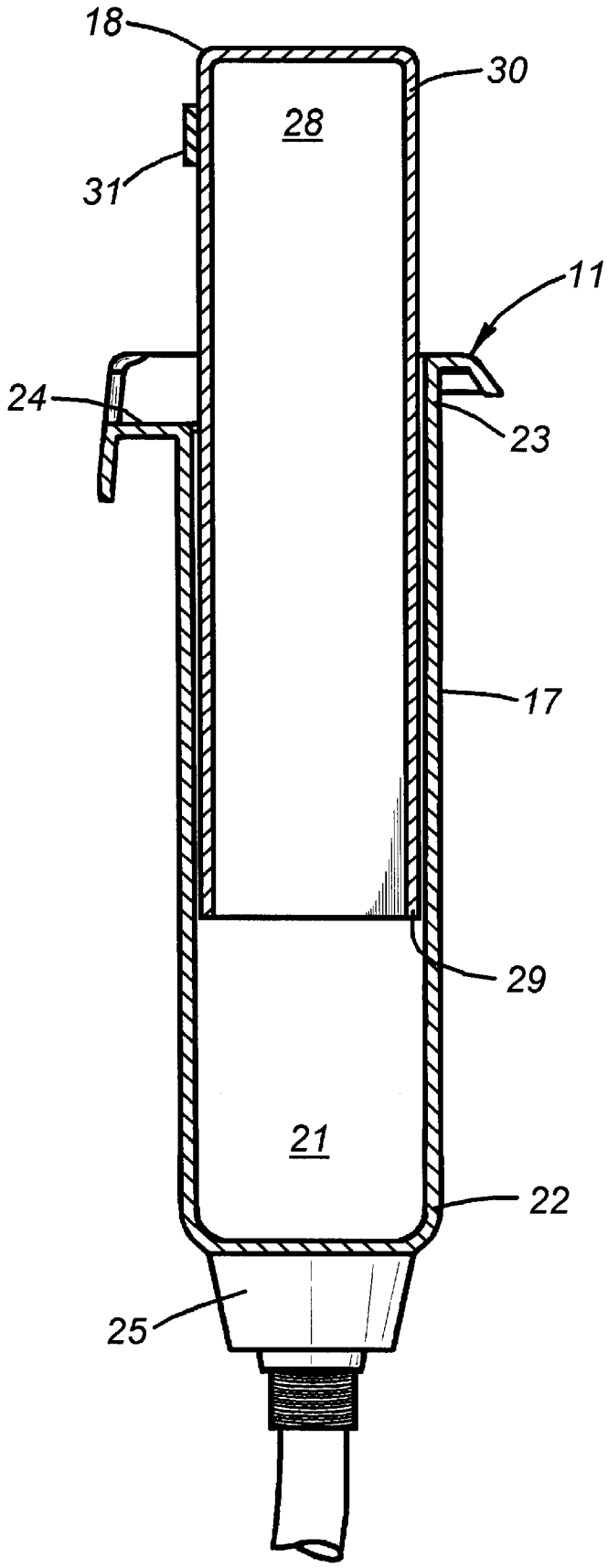
FIG. 4 is a side elevation view of the waterfall accessory with portions in cross section as viewed in a vertical plane that contains a line 4—4 in FIG. 3.
Figure 5:
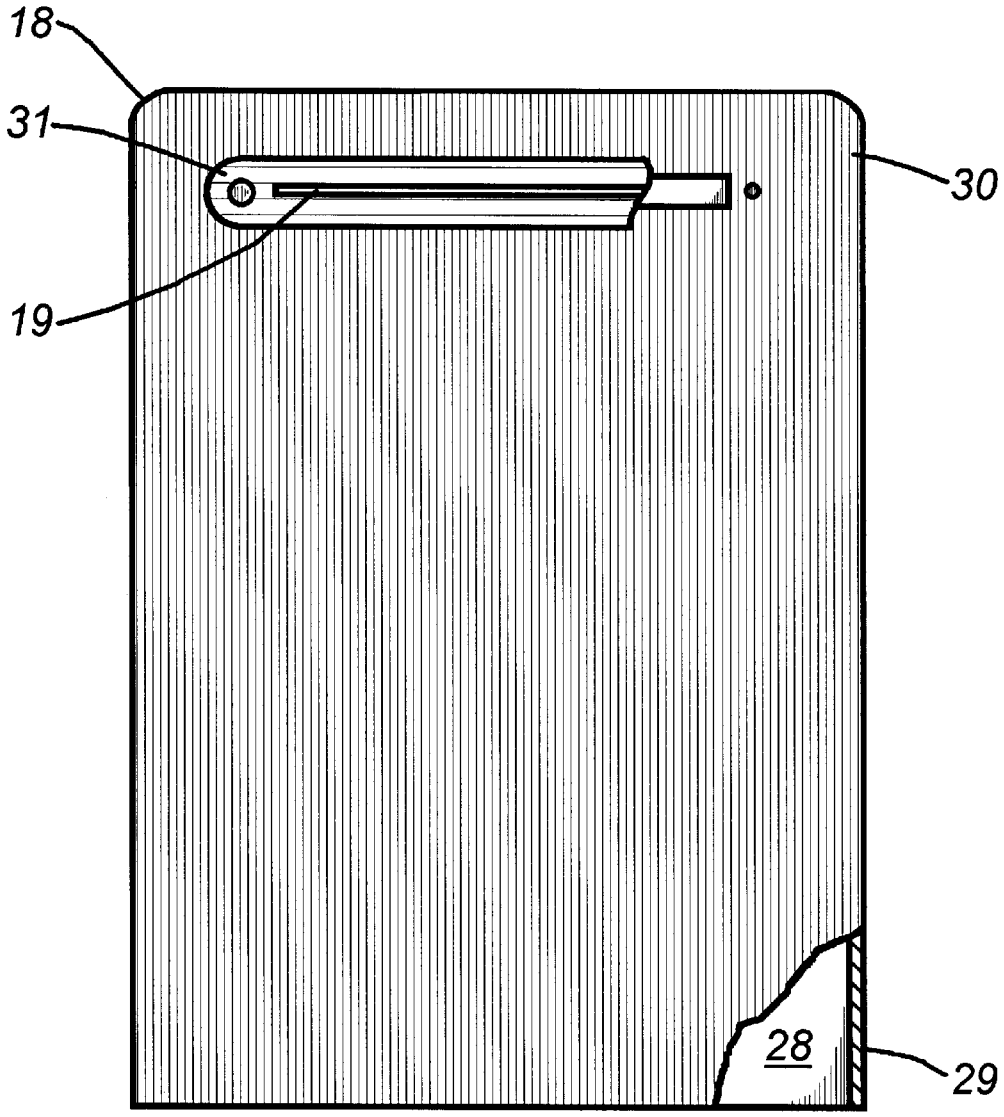
FIG. 5 is a front elevation view of just the movable element of the waterfall accessory, with portions broken away to expose the interior.

Further construction details of the waterfall apparatus 11 relating to the hydraulic method of raising the water-sheeting manifold 18 are shown in FIGS. 3–5. The housing 17 is a rigid object (e.g., 0.25-inch thick plastic, fiberglass, metal, etc.) and it defines an upwardly opening chamber 21 that is identified in FIG. 4. The upwardly opening chamber 21 extends from a bottom portion 22 of the housing 17 to a top portion 23 of the housing 17. As an idea of size, the upwardly opening chamber 21 of the illustrated housing 17 is about 20 inches high and about 29 inches wide. Of course, those dimensions may vary within the inventive concepts described.

The housing 17 is mounted within the sidewall 14 of the spa 10 (e.g., the sidewall is molded around it) so that a lip 24 on the housing 17 (FIGS. 3 and 4) is located slightly below the level of the upper edge 16 of the sidewall 14. A water inlet 25 on the bottom portion 22 of the housing 17 (FIGS. 3 and 4) is in fluid communication with the upwardly opening chamber 21, and it functions as means for coupling water from a separate source 26 of pressurized water (e.g., the spa water source) to the upwardly opening chamber 21 via an ON/OFF valve 27 (FIG. 3). The valve 27 is adapted to function as means for enabling a user to control the flow of water from the source 26 to the waterfall apparatus 11 in order to thereby selectively raise and lower the water-sheeting manifold 18 under influence of water pressure in the upwardly opening chamber 21.

The water-sheeting manifold 18 (FIGS. 3–5) is also a rigid object and it defines a downwardly opening chamber 28 that extends from a lower portion 29 of the water-sheeting manifold 18 to an upper portion 30 (FIGS. 4 and 5). The water-sheeting manifold 18 fits within the upwardly opening chamber 21 moveably for upward movement under influence of water pressure in the upwardly opening chamber 21, from the lowered first position depicted in FIG. 2 in which the water-sheeting manifold 18 presents a low profile, to the elevated second position depicted in FIGS. 1 and 4 in which the water-sheeting manifold 18 presents a higher profile and discharges the sheet of water 20 simulating a natural waterfall. For that purpose, the exterior portion of the water-sheeting manifold that fits into the upwardly opening chamber 21 has the same shape as, but slightly small size than, the upwardly opening chamber 21.

The water outlet 19 on the water-sheeting manifold 18 takes the in the form of a horizontally extending slot in a plastic slot-defining insert 31 on the upper portion 30 of the water-sheeting manifold 18. In the elevated position, the water outlet 19 occupies a position above the housing 17 a s illustrated in FIGS. 1, 3, and 4. In the lowered position illustrated in FIG. 2, the water outlet 19 occupies a position just slightly above the lip 24 on the upper portion 23 of the housing 17. In the lowered position, the water-sheeting manifold 18 is nestled within the housing 17 so that it presents a low profile.

To turn on the waterfall apparatus 10, a user operates the valve 27 so that water flows from the source 26 into the upwardly opening chamber 21 in the housing 17. As that occurs, water flows into the downwardly opening chamber 28 in the water-sheeting manifold 18. As water pressure increases, the water-sheeting manifold rises (pops up) to the elevated position and water flows out of the water outlet 19 in the form of the sheet of water 20. The amount of water pressure required is a dependent on the weight of the water-sheeting manifold 18. Operation is also affected by the size of the water outlet 19 and by the amount of water leaking out in the space between the water-sheeting manifold 18 and the housing 17. One of ordinary skill in the art can readily adjust those factors to achieve satisfactory operation, and add suitable additional means for limiting the upward travel of the water-sheeting manifold 18. Notice that the lip 24 helps serve the function of routing water leakage back to the spa.

Thus, the invention provides a pop-up waterfall apparatus that presents a low profile when not in use. Although an exemplary embodiment has been shown and described, one of ordinary skill in the art may make many changes, modifications, and substitutions without necessarily departing from the spirit and scope of the invention.

What is claimed is:

1. A waterfall apparatus, comprising:

a housing defining an upwardly opening chamber that extends from a bottom portion of the housing to a top portion of the housing; and a water-sheeting manifold that fits at least partially within the upwardly opening chamber;

the housing including a water inlet in fluid communication with the upwardly opening chamber that functions as means for coupling wager from a separate source of pressurized water to the upwardly opening chamber; and the water-sheeting manifold fitting in the upwardly opening chamber moveably for upward movement under influence of water pressure in the upwardly opening chamber from a lowered first position in which the water-sheeting manifold presents a low profile to an elevated second position in which the water-sheeting manifold presents a higher profile and discharges a sheet of water simulating a waterfall;

wherein the top portion of the housing includes an upper edge and a drainage lip slightly lower than the upper edge that facilitates drainage of water from the upwardly opening chamber when the water-sheeting manifold rises above the drainage lip.

2. A spa, comprising:

a container for a reservoir of water having a sidewall that extends upwardly to an upper portion of the sidewall;

a housing defining an upwardly opening chamber that extends from a bottom portion of the housing to a top portion of the housing; and a water-sheeting manifold that fits at least partially within the upwardly opening chamber;

the housing including a water inlet in fluid communication with the upwardly opening chamber that functions as means for coupling water from a separate source of pressurized water to the upwardly opening chamber;

the housing being mounted in the sidewall of the container so that the top portion of the housing extends to the upper portion of the sidewall; and the water-sheeting manifold fitting in the upwardly opening chamber moveably for upward movement under influence of water pressure in the upwardly opening chamber from a lowered first position in which the water-sheeting manifold presents a low profile to an elevated second position in which the water-sheeting manifold presents a higher profile and discharges a sheet of water simulating a waterfall.

3. A spa, comprising:

a container for a reservoir of water having a sidewall that extends upwardly to an upper portion of the sidewall;

a housing defining an upwardly opening chamber that extends from a bottom portion of the housing to a top portion of the housing; and a water-sheeting manifold that fits at least partially within the upwardly opening chamber;

the housing including a water inlet in fluid communication with the upwardly opening chamber that functions as means for coupling water from a separate source of pressurized water to the upwardly opening chamber;

the housing being mounted in the sidewall of the container so that the top portion of the housing extends to the upper portion of the sidewall; and the water-sheeting manifold fitting in the upwardly opening chamber moveably for upward movement under influence of water pressure in the upwardly opening chamber from a lowered first position in which the water-sheeting manifold presents a low profile to an elevated second position in which the water-sheeting manifold presents a higher profile and discharges a sheet of water simulating a waterfall;

wherein the spa includes a valve adapted to function as means for enabling a user to control a flow of water from the separate source of pressurized water to the upwardly opening chamber.

* * * * *